US011480327B2

(12) United States Patent
Zeng

(10) Patent No.: US 11,480,327 B2
(45) Date of Patent: Oct. 25, 2022

(54) LED LAMP

(71) Applicant: SHENZHEN BAOMINGDA SEMI-CONDUCTOR LIGHTING CO., LTD., Shenzhen (CN)

(72) Inventor: Jifu Zeng, Shenzhen (CN)

( * ) Notice: Subject to any disclaimer, the term of this patent is extended or adjusted under 35 U.S.C. 154(b) by 0 days.

(21) Appl. No.: 17/207,594

(22) Filed: Mar. 19, 2021

(65) Prior Publication Data

US 2022/0136690 A1 May 5, 2022

(51) Int. Cl.

| | |
|---|---|
| ***F21V 29/77*** | (2015.01) |
| ***F21V 3/00*** | (2015.01) |
| ***F21V 23/00*** | (2015.01) |
| ***F21V 17/18*** | (2006.01) |
| ***F21V 17/12*** | (2006.01) |
| ***F21V 5/04*** | (2006.01) |
| ***F21V 5/00*** | (2018.01) |
| ***F21Y 115/10*** | (2016.01) |

(52) U.S. Cl.

CPC ..... *F21V 29/773* (2015.01); *F21V 3/00* (2013.01); *F21V 5/007* (2013.01); *F21V 5/048* (2013.01); *F21V 17/12* (2013.01); *F21V 17/18* (2013.01); *F21V 23/007* (2013.01); *F21Y 2115/10* (2016.08)

(58) Field of Classification Search

None

See application file for complete search history.

(56) References Cited

U.S. PATENT DOCUMENTS 7,131,758 B2 * 11/2006 Ishida ..... F21S 41/155 362/545

FOREIGN PATENT DOCUMENTS

| | | | | |
|---|---|---|---|---|
| CN | 202521394 U | * | 11/2012 | ..... F21V 5/007 |
| CN | 110671680 A | * | 1/2020 | ..... F21V 5/04 |
| CN | 214009124 U | * | 8/2021 | |

* cited by examiner

*Primary Examiner* — Alan B Cariaso

(74) *Attorney, Agent, or Firm* — Rumit R. Kanakia

(57) ABSTRACT

The invention discloses a LED lamp, which comprises a heat dissipation shell, an anti-glare lampshade arranged on a top of the heat dissipation shell, a power supply seat arranged on a bottom of the heat dissipation shell, and a condensing assembly and a LED light source plate sequentially arranged in the heat dissipation shell, wherein an outside of the heat dissipation shell is provided with a plurality of heat dissipation ribs, and the top of the heat dissipation shell is provided with a plurality of heat dissipation holes; the condensing assembly comprises a plurality of supporting frames and a lens arranged on each supporting frame, the supporting frame is provided with a plurality of buckles, and the lens is provided with clamping grooves corresponding to the buckles; and the lens is clamped with the buckles of the supporting frame through the clamping grooves. The lamp of the invention has good heat dissipation, low power consumption, and excellent energy saving, a 1,000 W halogen lamp can be replaced with an 80 W LED lamp with a same brightness, and the LED lamp has a long service life; and the heat dissipation shell and the power supply seat are fixed through an internal screw, thus avoiding the screw from rusting due to long-term external placement to affect a service life.

9 Claims, 5 Drawing Sheets

LED LAMP

CROSS-REFERENCE TO RELATED APPLICATIONS

This application claims priority to Chinese Patent Application No. 202011087424.8, filed Nov. 5, 2020, the entire disclosure of which is hereby incorporated by reference in its entirety.

TECHNICAL FIELD

The present invention relates to the field of LED lamp technologies, and more particularly, to a LED lamp.

BACKGROUND ART

At present, there is only a PAR64 incandescent lamp and halogen lamp light source in the market, which usually has powers of 500 W and 1,000 W, with high power consumption, a high calorific value, a short service life (about 2,000 hours), and a fragile glass shell. The existing PAR64 has a simple use scene, a single use color, and a poor heat dissipation effect, which seriously affects a service life.

SUMMARY OF THE INVENTION

Aiming at the problems in the prior art, the present invention provides a LED lamp, which has the advantages of a heat dissipation effect, a long service life, light condensation, and anti-glare.

In order to achieve the above objective, the technical solutions of the present invention are as follows.

A LED lamp comprises a heat dissipation shell, an anti-glare lampshade arranged on a top of the heat dissipation shell, a power supply seat arranged on a bottom of the heat dissipation shell, and a condensing assembly and an LED light source plate sequentially arranged in the heat dissipation shell, wherein an outside of the heat dissipation shell is provided with a plurality of heat dissipation ribs, and the top of the heat dissipation shell is provided with a plurality of heat dissipation holes; the condensing assembly comprises a plurality of supporting frames and a lens arranged on each supporting frame, the supporting frame is provided with a plurality of buckles, and the lens is provided with clamping grooves corresponding to the buckles; and the lens is clamped with the buckles of the supporting frame through the clamping grooves.

Preferably, the power supply seat is provided with a first accommodating cavity, the first accommodating cavity is a hexagonal prismatic cavity, and a side wall of the first accommodating cavity is provided with a plurality of elongated slots; and the elongated slots have a same direction, which is consistent with an axial direction of the first accommodating cavity.

Preferably, first through holes corresponding to the slots one to one are arranged in an inner ring plate at an opening of the heat dissipation shell; the LED lamp further comprises a plurality of first screws and a plurality of second screws; and each first screw passes through one corresponding first through hole to be placed in one slot, so as to fix the power supply seat and the heat dissipation shell.

Preferably, the PAR64 lamp further comprises a driving power supply; the driving power supply is arranged in the first accommodating cavity of the power supply seat; and an output terminal of the driving power supply is electrically connected with the LED light source plate.

Preferably, the LED lamp further comprises a substrate; and the driving power supply is arranged on the substrate.

Preferably, each side of the substrate is correspondingly provided with two second through holes, and corresponding second screws pass through the second through holes to fix the substrate.

Preferably, a bottom of the power supply seat is also provided with an electricity-connected pin, and the electricity-connected pin is electrically connected with an input end of the driving power supply.

Preferably, the supporting frame of the lens is provided with a second accommodating cavity, and the second accommodating cavity is a hexagonal prismatic cavity, has a same shape as the first accommodating cavity, and is capable of changing with a change of the shape of the first accommodating cavity.

Preferably, the heat dissipation shell is selected from aluminum cold forging integrated molding or ceramic integrated molding.

Adoption of the technical solutions of the present invention has the following beneficial effects: the lamp of the present invention has good heat dissipation, low power consumption, and excellent energy saving, a 1,000 W halogen lamp can be replaced with an 80 W LED lamp with a same brightness, and the LED lamp has a long service life (more than 35,000 hours). The heat dissipation shell and the power supply seat are fixed through the internal screw, thus avoiding the screw from rusting due to long-term external placement to affect a service life. The supporting frame is connected with the lens in a clamping manner, so that the lens is fixed on the supporting frame, and is not easy to loosen, thus avoiding affecting a condensing effect.

DETAILED DESCRIPTION OF THE PREFERRED EMBODIMENTS

DETAILED DESCRIPTION OF THE PREFERRED EMBODIMENTS

Figure 1:
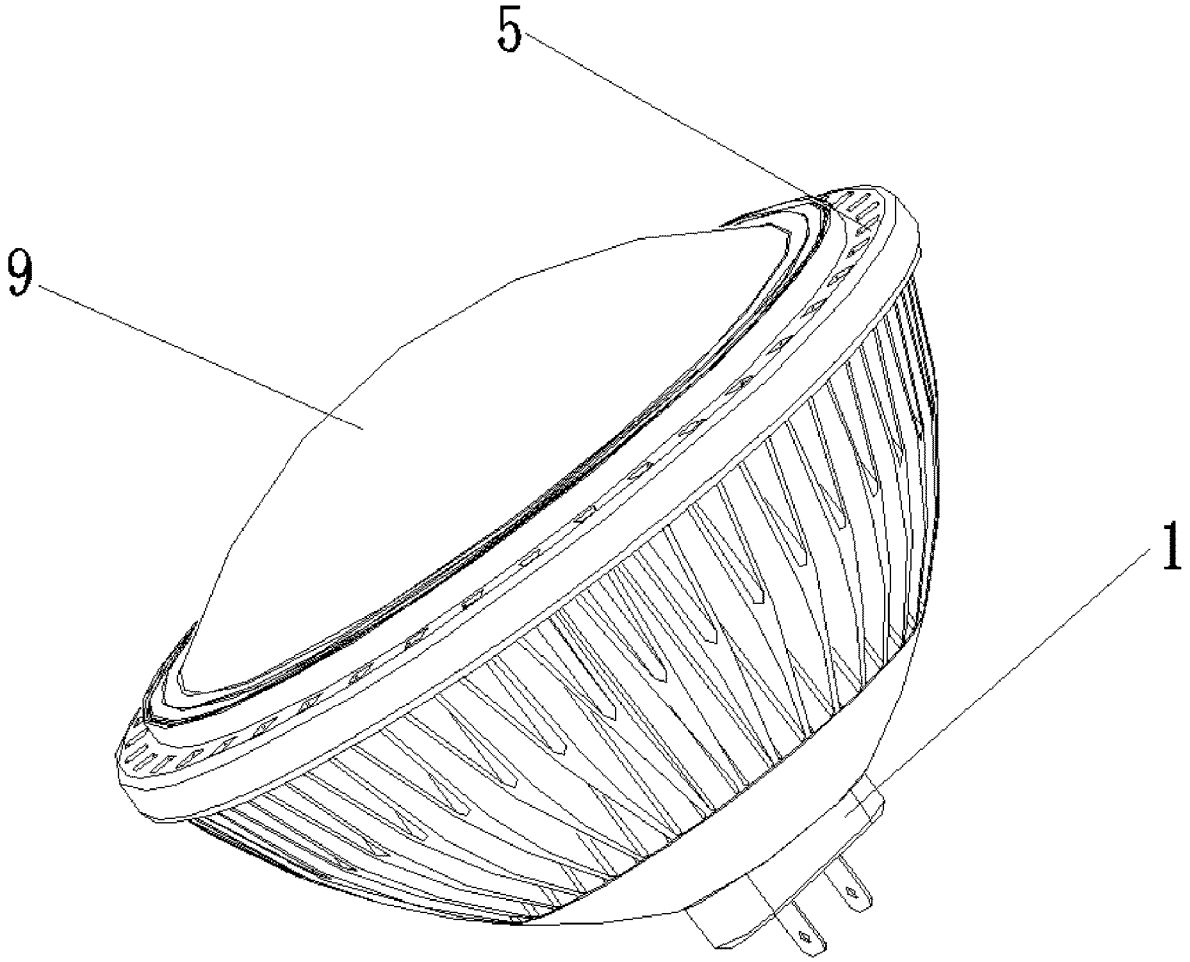
FIG. 1 is a schematic structure diagram of the present invention.

The embodiments of the present invention are described in detail hereinafter. Examples of the embodiments are shown in the accompanying drawings. The same or similar reference numerals throughout the accompanying drawings denote the same or similar elements or elements having the same or similar functions. The embodiments described hereinafter with reference to the accompanying drawings are exemplary and are intended to explain the present invention, but shall not be understood as limiting the present invention.

In the description of the present invention, it shall be understood that the orientation or position relationship indicated by the terms "center", "longitudinal", "transverse", "length", "width", "thickness", "up", "down", "front", "rear", "left", "right", "vertical", "horizontal", "top", "bottom", "inside", "outside", "clockwise", "anticlockwise", and the like is based on the orientation or position relationship shown in the accompanying drawings, it is only for the convenience of description of the present invention and simplification of the description, and it is not to indicate or imply that the indicated device or element must have a specific orientation, and be constructed and operated in a specific orientation. Therefore, the terms shall not be understood as limiting the present invention.

Moreover, the terms "first" and "second" are used for descriptive purposes only and cannot be understood as indicating or implying relative importance, or implicitly indicating the number of technical features indicated thereby. Therefore, the feature defined by "first" and "second" may explicitly or implicitly include one or more of the features. In the description of the present invention, the meaning of "multiple" is two or more than two, unless otherwise specifically defined.

In the present invention, the terms "installation", "connected", "connection", "fixing", and the like shall be understood in a broad sense unless otherwise specified and defined. For example, they may be fixed connection, removable connection or integrated connection; may be mechanical connection or electrical connection; and may be direct connection, or indirect connection through an intermediate medium, and connection inside two elements. The specific meanings of the above terms in the present invention may be understood in a specific case by those of ordinary skills in the art.

In the present invention, unless otherwise specified and limited, the first feature "on" or "under" the second feature may include direct contact between the first feature and the second feature, and may also include the contact between the first feature and the second feature through another feature therebetween instead of the direct contact. Furthermore, the first feature "on", "above" and "over" the second feature includes that the first feature is directly above and obliquely above the second feature, or only indicates that the first feature is higher than the second feature in a horizontal height. The first feature "under", "below" and "underneath" the second feature includes that the first feature is directly below and obliquely below the second feature, or only indicates that the first feature is lower than the second feature in a horizontal height.

Figure 2:
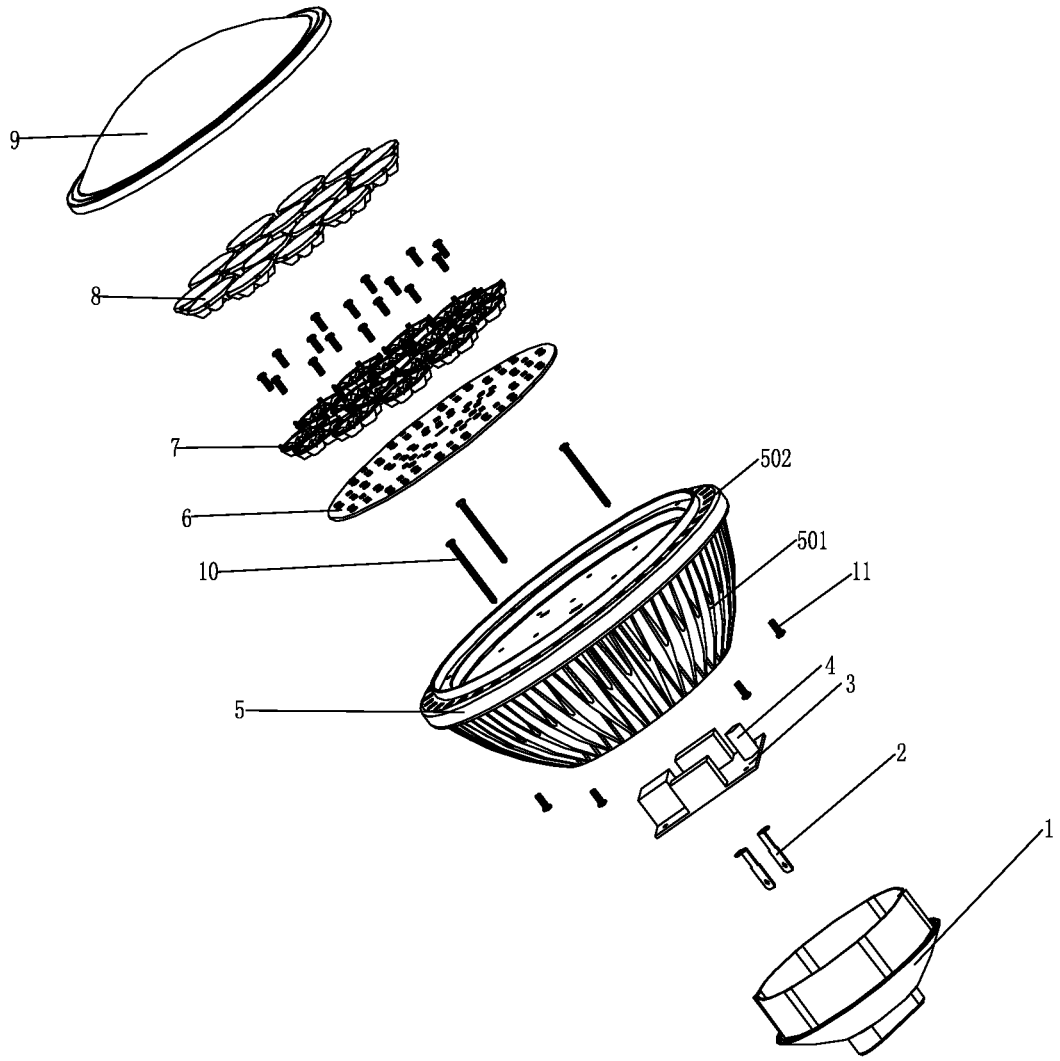
FIG. 2 is an exploded structure diagram of the present invention.
Figure 3:
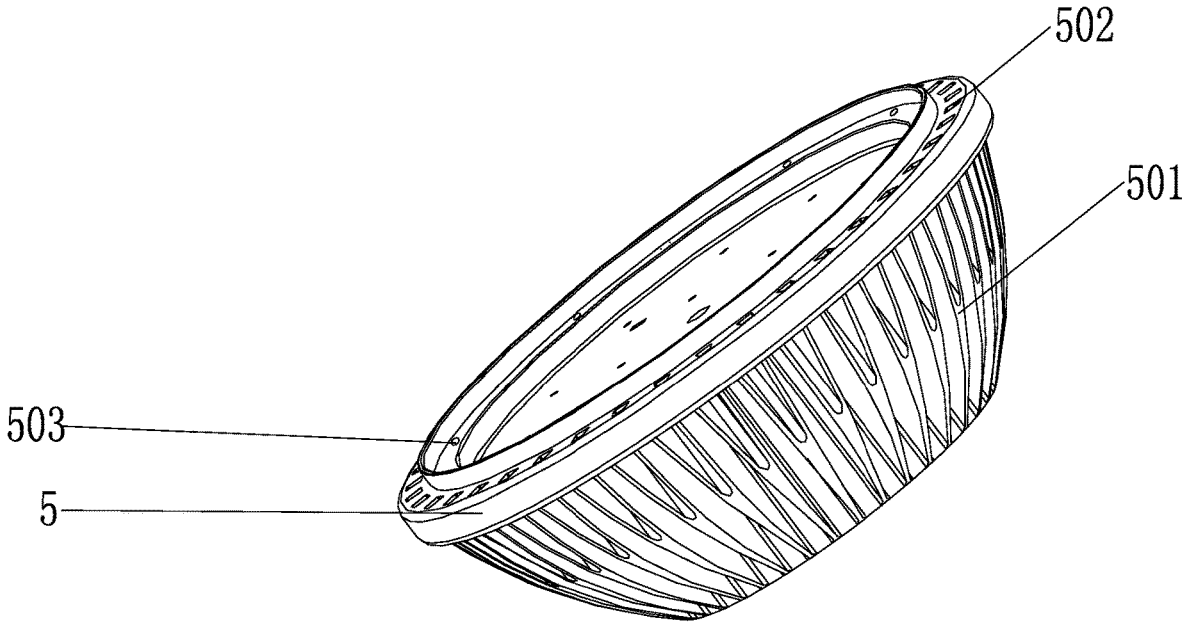
FIG. 3 is a schematic structure diagram of a heat dissipation shell of the present invention.
Figure 4:
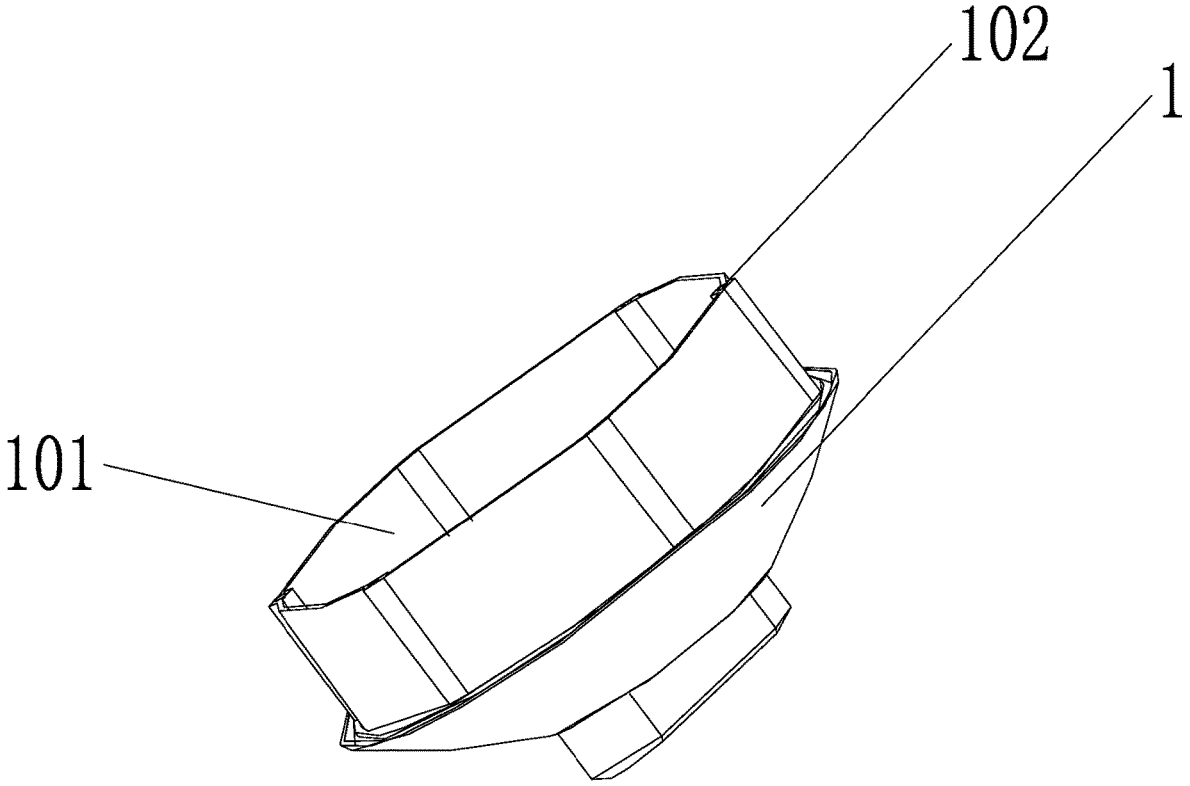
FIG. 4 is a schematic structure diagram of a power supply seat of the utility model.
Figure 5:
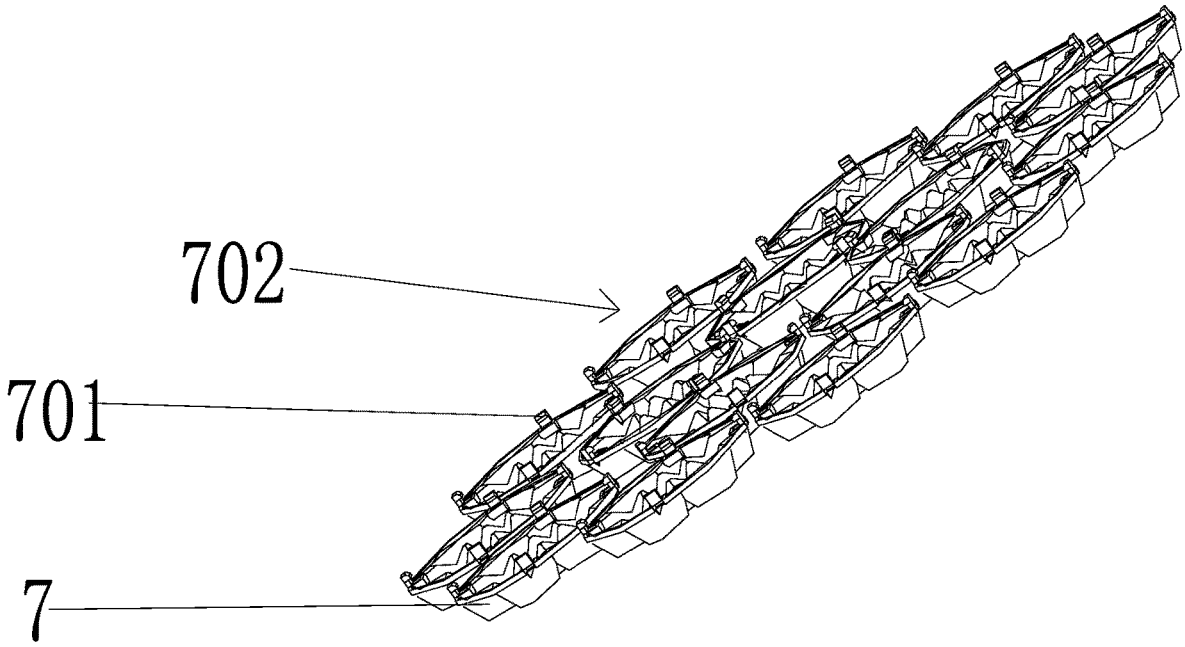
FIG. 5 is a schematic structure diagram of supporting frames of the present invention.
Figure 6:
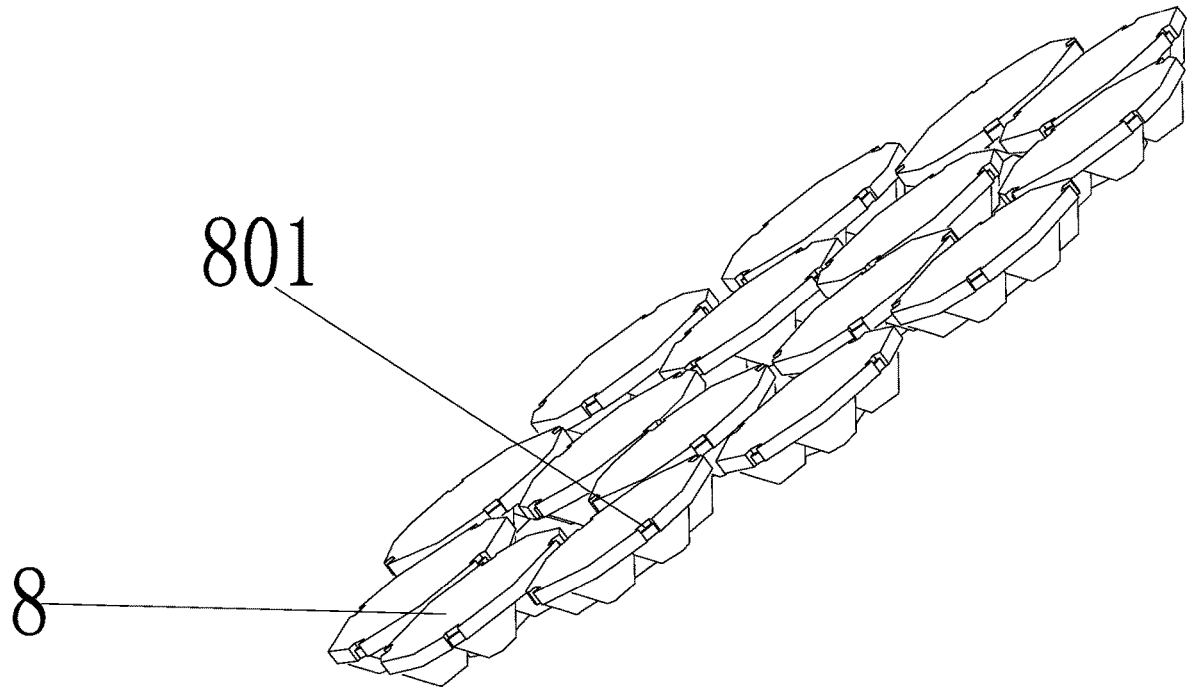
FIG. 6 is a schematic structure diagram of lenses of the present invention.

With reference to FIG. 1 to FIG. 6, the present invention provides a LED lamp, which comprises a heat dissipation shell 5, an anti-glare lampshade 9 arranged on a top of the heat dissipation shell 5, a power supply seat 1 arranged on a bottom of the heat dissipation shell 5, and a condensing assembly and a LED light source plate 6 sequentially arranged in the heat dissipation shell 5, wherein a matching design between the condensing assembly and the anti-glare lampshade 9 is to avoid human eyes from dazzling due to diffusion of light, and is also to condense the light so as to increase a power utilization rate of the lamp. An outside of the heat dissipation shell 5 is provided with a plurality of heat dissipation ribs 501, and the design mode may facilitate circulation of air in use, so that an existing LED light source plate plays a role of heat dissipation in use. The top of the heat dissipation shell is provided with a plurality of heat dissipation holes 502, and the design mode is matched with the heat dissipation ribs 501, so that heat of the LED light source plate is more easily dissipated. The condensing assembly comprises a plurality of supporting frames 7 and a lens 8 arranged on each supporting frame 7, the supporting frame 7 is provided with a plurality of buckles 701, the lens 8 is provided with clamping grooves 801 corresponding to the buckles 701, and the design mode facilitates assembly of various parts of the lamp, thus reducing a labor cost. The lens 8 is clamped with the buckles 701 of the supporting frame through the clamping grooves 801.

The power supply seat 1 is provided with a first accommodating cavity 101, the first accommodating cavity 101 is a hexagonal prismatic cavity, and a side wall of the first accommodating cavity 101 is provided with a plurality of elongated slots 102. The elongated slots 102 have a same direction, which is consistent with an axial direction of the first accommodating cavity 101, and the design mode facilitates assembly and screwing first, and also allows assembly and fixing from an interior of the lamp, thus having effects of waterproof and dustproof.

First through holes 503 corresponding to the slots 102 one to one are arranged in an inner ring plate at an opening of the heat dissipation shell 5. The LED lamp further comprises a plurality of first screws 10 and a plurality of second screws 11. Each first screw 10 passes through one corresponding first through hole 503 to be placed in one slot 102. The heat dissipation shell 5 and the power supply seat 1 are fixed through the internal first screw, thus avoiding the screw from rusting due to long-term external placement to affect a service life.

The PAR64 lamp further comprises a driving power supply 4. The driving power supply 4 is placed in the first accommodating cavity 101 of the power supply seat 1, thus saving a space of the lamp, and reducing a cost.

The PAR64 lamp further comprises a substrate 3. The driving power supply 4 is arranged on the substrate 3.

Each side of the substrate is correspondingly provided with two second through holes, and corresponding second screws pass through the second through holes to fix the substrate in the first accommodating cavity 101 of the power supply seat, thus preventing the substrate 3 from loosening.

A bottom of the power supply seat 1 is also provided with an electricity-connected pin 2, and the electricity-connected pin 2 is electrically connected with an input end of the driving power supply 4. When the electricity-connected pin 2 is plugged into an external socket, the driving power supply 4 may be charged.

An output terminal of the driving power supply 4 is electrically connected with the LED light source plate 6. The driving power supply 4 is used for supplying power to the LED light source plate 6.

The supporting frame 7 of the lens is provided with a second accommodating cavity 702, and the second accommodating cavity 702 is a hexagonal prismatic cavity, has a same shape as the first accommodating cavity 101, and is capable of changing with a change of the shape of the first accommodating cavity 101. The supporting frame 7 of the lens is used for supporting and fixing the lens 8, thus preventing the lens 8 from loosening to affect a condensing effect.

The heat dissipation shell 5 is selected from aluminum cold forging integrated molding or ceramic integrated molding, which can improve a strength of the heat dissipation shell, and prevent the heat dissipation shell from being easily damaged.

Working Principle of the Present Invention:

The electricity-connected pin 2 of the power supply seat 1 is plugged into the external socket during working, the driving power supply 4 supplies power to the LED light source plate 6, the LED light source plate 6 is turned on, and emitted light is condensed by the lens 8 and then emitted through the anti-glare lampshade 9.

A structure is improved in the present invention, so that the lamp has good heat dissipation, low power consumption, and excellent energy saving, a 1,000 W halogen lamp can be replaced with an 80 W LED lamp with a same brightness, and the LED lamp has a long service life (more than 35,000 hours). The heat dissipation shell and the power supply seat are fixed through the internal screw, thus avoiding the screw from rusting due to long-term external placement to affect a service life. The supporting frame is connected with the lens in a clamping manner, so that the lens is fixed on the supporting frame, and is not easy to loosen, thus avoiding affecting a condensing effect.

The foregoing is only the preferred embodiments of the present invention, which do not limit the patent scope of the present invention. Any equivalent structure transformation made by the contents of the specification and the drawings of the present invention under the inventive concept of the present invention, or direct or indirect application in other related technical fields falls within the scope of protection of the patent of the present invention.

What is claimed is:

1. A LED lamp, comprising a heat dissipation shell, an anti-glare lampshade arranged on a top of the heat dissipation shell, a power supply seat arranged on a bottom of the heat dissipation shell, and a condensing assembly and a LED light source plate sequentially arranged in the heat dissipation shell, wherein an outside of the heat dissipation shell is provided with a plurality of heat dissipation ribs, and the top of the heat dissipation shell is provided with a plurality of heat dissipation holes; the condensing assembly comprises a plurality of supporting frames and a lens arranged on each supporting frame, the supporting frame is provided with a plurality of buckles, and the lens is provided with clamping grooves corresponding to the buckles; and the lens is clamped with the buckles of the supporting frame through the clamping grooves.

2. The LED lamp according to claim 1, wherein the power supply seat is provided with a first accommodating cavity, the first accommodating cavity is a hexagonal prismatic cavity, and a side wall of the first accommodating cavity is provided with a plurality of elongated slots; and the elongated slots have a same direction, which is consistent with an axial direction of the first accommodating cavity.

3. The LED lamp according to claim 2, wherein first through holes corresponding to the slots one to one are arranged in an inner ring plate at an opening of the heat dissipation shell; the LED lamp further comprises a plurality of first screws and a plurality of second screws; and each first screw passes through one corresponding first through hole to be placed in one slot, so as to fix the power supply seat and the heat dissipation shell.

4. The LED lamp according to claim 2, wherein the LED lamp further comprises a driving power supply; the driving power supply is arranged in the first accommodating cavity of the power supply seat; and an output terminal of the driving power supply is electrically connected with the LED light source plate.

5. The LED lamp according to claim 4, wherein the LED lamp further comprises a substrate; and the driving power supply is arranged on the substrate.

6. The LED lamp according to claim 5, wherein each side of the substrate is correspondingly provided with two second through holes, and corresponding second screws pass through the second through holes to fix the substrate.

7. The LED lamp according to claim 5, wherein a bottom of the power supply seat is also provided with an electricity-connected pin, and the electricity-connected pin is electrically connected with an input end of the driving power supply.

8. The LED lamp according to claim 2, wherein the supporting frame of the lens is provided with a second accommodating cavity, and the second accommodating cavity is a hexagonal prismatic cavity, has a same shape as the first accommodating cavity, and is capable of changing with a change of the shape of the first accommodating cavity.

9. The LED lamp according to claim 3, wherein the heat dissipation shell is selected from aluminum cold forging integrated molding or ceramic integrated molding.

* * * * *